United States Patent [19]

Jenness

[11] 4,116,391

[45] Sep. 26, 1978

[54] BALL DISCHARGER FOR GRINDING MILL

[75] Inventor: Raymond C. Jenness, Milwaukee, Wis.

[73] Assignee: Allis-Chalmers Corporation, Milwaukee, Wis.

[21] Appl. No.: 804,053

[22] Filed: Jun. 6, 1977

[51] Int. Cl.[2] ..... B02C 17/18

[52] U.S. Cl. ..... 241/171

[58] Field of Search ..... 241/70, 79.2, 79.3, 241/171, 181

[56] References Cited

U.S. PATENT DOCUMENTS

| | | | |
|---|---|---|---|
| 2,259,769 | 10/1941 | Newhouse | 241/70 |
| 2,405,633 | 8/1946 | Barker | 241/70 |
| 3,601,323 | 8/1971 | Glencke | 241/171 X |
| 3,739,993 | 6/1973 | Nelson et al. | 241/70 |
| 3,801,025 | 4/1974 | Slegten | 241/181 X |

*Primary Examiner*—Howard N. Goldberg

*Attorney, Agent, or Firm*—Robert C. Jones

[57] ABSTRACT

A radially extending scoop is fastened internally to the discharge end wall of a ball mill structure for rotation with the mill; rotation of the mill will cause the grinding media and pulp to cascade and the scoop will fill and direct the material inwardly toward the mill center and discharge it into a conical cylinder in the mill trunnion which directs the discharge into a receptacle.

3 Claims, 6 Drawing Figures

BALL DISCHARGER FOR GRINDING MILL

BACKGROUND OF THE INVENTION

1. Field of the Invention

This invention relates to an improved ball discharge assembly for a rotary grinding mill and more particularly to a grinding media discharger assembly for a rotary grinding mill which includes a ball scoop rotating with the mill which directs the balls to the discharge opening for deposit into a suitable receptacle.

2. Description of the Prior Art

It is known to discharge the grinding media of a rotary mill through manholes let into the wall of the mill. However, this construction requires a great number of different configured liner plates so as to accommodate the manhole construction. This, of course, increases the construction cost of the mill. Another manner to remove steel grinding balls from a rotary mill is by means of a traveling magnet structure which is mounted externally of the mill and arranged to travel into the mill on a truckway. The magnet is moved into the mill and magnetized to secure a load of the steel balls. The magnet with its load is withdrawn from the mill to deposit the load of balls into a bin. With this method of unloading the steel grinding balls from a mill, the magnet structure including the truckway is limited in size to the available discharge opening of the mill. Still another way of removing the steel grinding balls from a mill is by manual labor which, of course, is slow and tedious and in the case of large diameter mills, almost impossible.

SUMMARY OF THE INVENTION

According to a preferred embodiment of the present invention, a radially extending trough or scoop is bolted to the end of the grinding mill on the exterior surface of the end liners thereof during the period of time of media or charge removal. The arm extends radially to the interior of the shell. The scoop is formed as a trough with the end of the arm towards the shell being modified so as to present a scoop which faces in the direction in which the mill rotates. As the mill rotates, the trough will rotate with the mill. The grinding media and any residual pulp will ride up the side of the shell and cascade after reaching a maximum height. The cascading material will fill the trough and flow radially along the trough towards the mill center. The material flowing through the trough towards the mill center discharges into a conical cylinder in the mill trunnion and deposits into a suitable container.

DESCRIPTION OF THE PREFERRED EMBODIMENT

Figure 1:
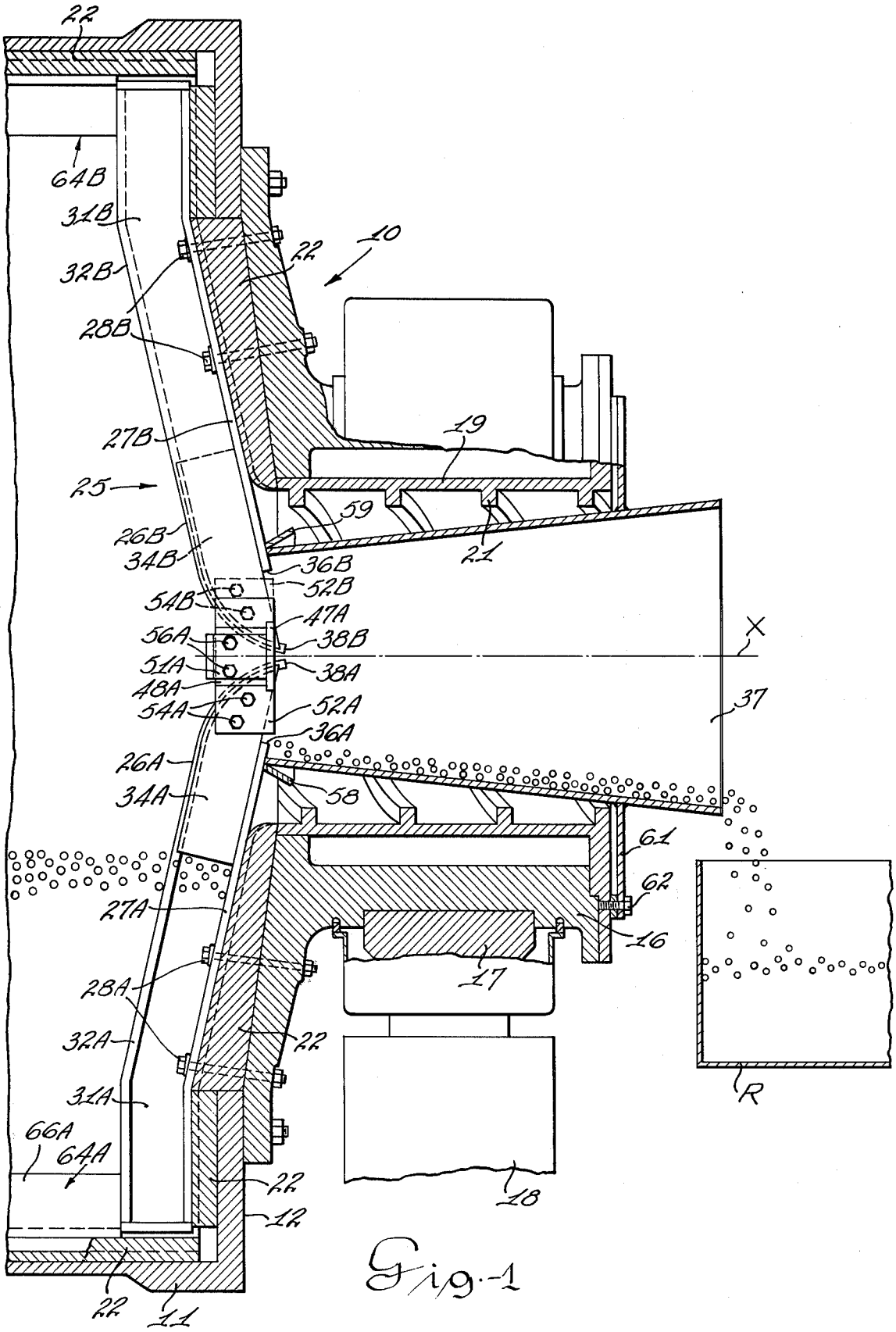
FIG. 1 is a vertical view of the discharge end of a grinding mill provided with two ball discharge scoops.

Referring now to FIG. 1 of the drawings, there is shown the discharge end of a rotary grinding mill generally indicated by the reference number 10. The mill includes a hollow shell 11 to which is secured a discharge end wall 12. From the end wall 12 a combination end head with integral hollow discharge trunnion 16 which serves to rotatably support one end of the mill 10 for rotation about a horizontal axis. The trunnion 16 is received in a bearing 17 carried by a support 18. Drive means (not shown) are provided for rotating the grinding mill 10. A trunnion liner 19 within the trunnion 16 is constructed with a reverse spiral arrangement 21, which tends to prevent outward advancement of the ball media is located within the hollow trunnion. Residual pulp, by displacement, will overflow the reverse spiral arrangement and be discharged. The interior of the mill 10 including the discharge end wall 12 is lined with wear liners 22.

Figure 4:
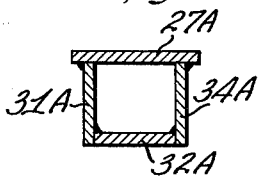
FIG. 4 is a sectional view taken in a plane represented by the line IV—IV in FIG. 2.
Figure 5:
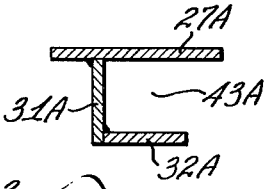
FIG. 5 is a sectional view taken in a plane represented by line V—V in FIG. 2.

In the particular illustrative embodiment of the invention, the ball discharge scoop 25 is shown with two diametrically extending scoops 26A and 26B which abuts the discharge end 12 of the mill. It will be appreciated that the scoops may be one or more depending upon the requirement of speed of ball discharge required. The ball scoops 26A and 26B are identical and therefore a description of the scoop 26A will also apply to the scoop 26B with like elements being identified by the same reference numbers followed by the letter A for elements of scoop 26A and the letter B for elements associated with scoop 26B. As shown, the ball scoop 26A includes a base plate 27A which is formed to conform to the interior configuration of the discharge end wall 12. Bolts 28A which secure the liners 22 to the shell 12 and head 16 are also utilized to secure the base plate 27A in operating position. In the particular illustration, the operating movement of the mill is in a counterclockwise direction as viewed in FIG. 2, as indicated by the directional arrow 29. Extended along one side of the base plate 27A is a backplate 31A which is welded to the base plate 27A. As indicated in FIG. 5, a top plate 32A is welded to the upstanding backplate 31A and serves as a cover for the scoop. Towards the rotational axis of the mill 10, and as shown in FIGS. 1 and 4, the scoop is provided with a sectional front plate 34A which is disposed on the leading side of the scoop.

At the inner end of the scoop 26A the base plate 27A terminates as at 36A inwardly of the shell of a cylindrical cone-shaped discharge funnel 37. The top plate 32A at its inner end curves inwardly as at 38A, towards the axis X about which the mill rotates. The inner ends of the front plate 34A and backplate 31A are shaped to conform to the curvature of the inner end 38A of the top plate 32A. This arrangement forms a scoop discharge spout by which means the grinding media such as balls collected into the outer end 43A, indicated in FIG. 5, are directed in the cylindrical cone funnel.

Figure 2:
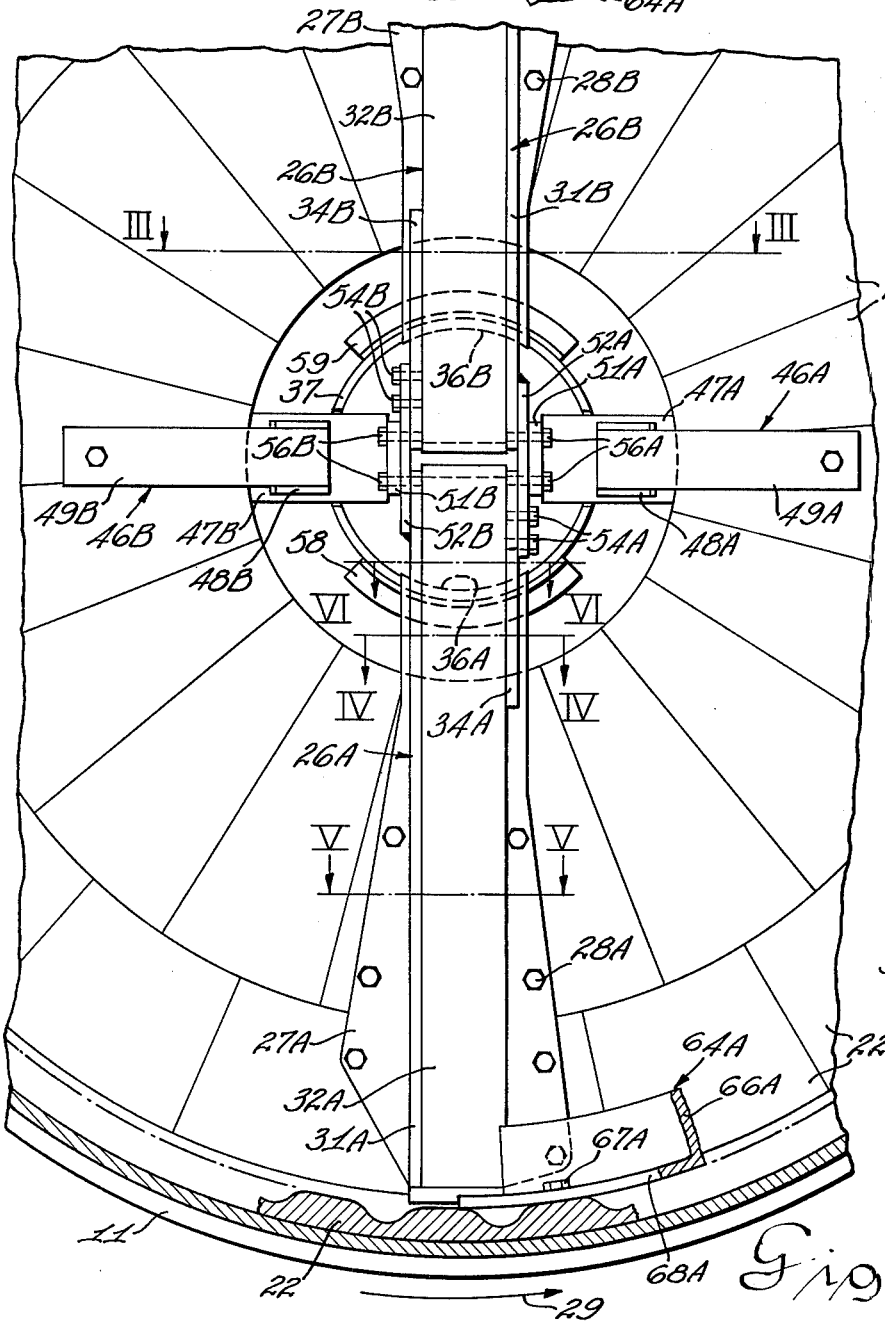
FIG. 2 is an enlarged fragmentary interior end view of the discharge end of the grinding mill showing the installation of one scoop or trough.
Figure 6:
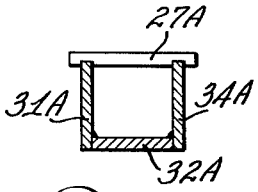
FIG. 6 is a sectional view taken in a plane represented by the line VI—VI in FIG. 2.

The inner ends of the scoops 26A and 26B are held in operative position by lateral braces 46A and 46B which can be identical, as shown. The brace 46A includes a shoe plate 47A having an upstanding spaced apart bracket 48A. An anchor plate 49A has one end welded between the spaced apart ears of the bracket 48A and its opposite end bolted to the wall of the discharge end 12 of the mill. A bucking plate 51A is welded to the inner end of the shoe plate 47A and abuts the side of a splice plate 52A. As shown in FIG. 2, one end of the splice plate 52A is welded to the backplate 31B of the ball scoop 26B. The opposite end of the splice plate 52A is bolted as at 54A to the front plate 34A. A pair of bolts 56A serve to secure the bucking plate 51A and the splice plate 52A together. Thus, the ball scoops 26A and 26B are removably secured in operative position on the interior surface of the discharge end 12 of the mill 10 and may be conveniently and easily removed after the ball media has been removed from the mill prior to recharging the mill with new grinding media.

As previously mentioned, the scoops discharge into the cylindrical conical funnel 37, which is arranged to be coaxial with the axis X, about which the mill rotates. To this purpose, the small diameter end of the funnel 37, as best shown in FIG. 1, is arranged to abut the base plates 27A and 27B which define the limit to which the funnel extends into the mill. Centering of the funnel so that its axis coincides with the axis X is effected by means of two segment sectors 58 and 59 which are diametrically opposite each other and welded near the ends 36A and 36B, respectively, of the plates 27A and 27B. The outer large diameter end of the funnel extends through a circular plate 61 which is welded to the funnel and abuts the outer face of the trunnion 16. Bolts 62, one of which is shown, secures the circular plate 61 to the trunnion and maintains the funnel coaxial with the rotational axis X. Thus, to remove the funnel the bolts 62 are removed and the funnel may be easily and simply withdrawn from the trunnion opening.

Figure 3:
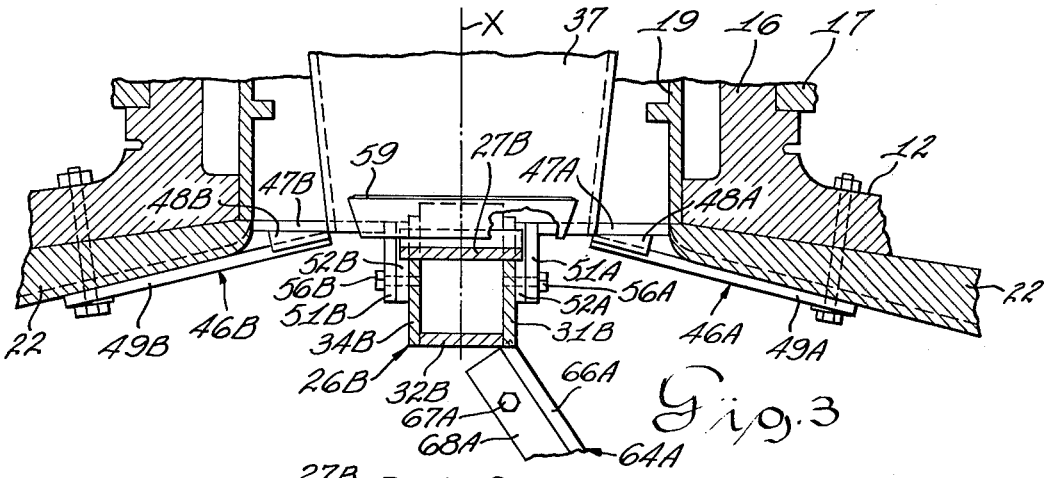
FIG. 3 is a sectional view taken in a plane represented by the line III—III in FIG. 2.

As an aid to directing the grinding media into the scoops, especially as the media and pulp near depletion, there is provided identical guide vanes 64A and 64B associated with each of the scoops 26A and 26B, respectively. The guide vane 64A is preferably a series of end-to-end related bar members 66A bolted to the liners 22. Vane 64A extends angularly from the leading corner edge of the scoop rearwardly away from the discharge end 12 of the mill towards the mill feed end (not shown). The arrangement being such that ball grinding media remaining within the mill after a substantial amount has been removed will be caused to roll along the vane into the open side 43A of the scoop. Vane sections 66A are angular in cross-section with bolts 67A, FIGS. 2 and 3, passing through the leg portion 68A which abuts the liners 22 to secure the vane in position.

The particular grinding mill shown is illustrative of an 18 foot diameter mill having approximately 500,000 pounds of the ball grinding media therein. To remove the grinding media from the mill, the rotation of the mill is stopped and the scoop 26B is assembled and bolted into position in the interior of the mill. The guide vane 64B is then bolted into position along the interior of the shell against the liners 22. With this accomplished, the mill is rotated 180° and the scoop 26A and guide vane 64A bolted into place. The funnel 37 is thereafter inserted into the trunnion and secured in position by bolts 62. With the scoops, vanes and funnel in position the mill is rotated at operating speed and in a counterclockwise direction. As the mill rotates, the grinding media and residual pulp cascades, the scoop 26A will fill lifting the grinding media and any residual pulp material from the mill. As the mill continues to rotate, the grinding media scooped up by the scoop 26A will flow radially along the scoop trough towards the center of the mill and be discharged into the conical cylindrical funnel 37 and thence into a suitable receptacle R which may be a storage bin, stock pile, truck, etc. As the mill continues its rotation, the scoop 26B will be rotated into the grinding media and as it moves with the mill in a upward path of travel will discharge its load into the funnel 37. As the grinding media within the mill is reduced in volume, the guide vanes 64A and 64B will operate to direct the remaining grinding media towards the open ends 43A and a like opening (not shown) of the respective scoops 26A and 26B. After the grinding mill has been emptied of the grinding media, operation of the mill is stopped and the scoops, guide vanes and conical cylindrical funnel removed readying the mill for subsequent operation with a new charge of grinding media.

From the foregoing description, it can be seen that a grinding media discharger arrangement has been provided which facilitiates removal of the grinding media from a grinding mill. The discharger is relatively inexpensive to manufacture as it can be made of low carbon steel plate. Less time is required for the removal of the grinding media thereby reducing mill downtime. It eliminates the provision of manhole openings and the special liners that would be required around the manhole and also manhole liners.

The embodiments of the invention in which an exclusive property or privilege is claimed are defined as follows:

1. A grinding media discharger for a rotary grinding mill having a hollow shell body provided with a discharge end wall including an outlet into a hollow trunnion and a feed end, said hollow shell body having an axis coaxial with the axis about which the mill rotates;

a grinding media pick-up means comprising a fabricated trough structure which is removably secured to the interior surface of the discharge end wall of the mill and extending radially from the discharge end wall outlet to the shell and being in communication with the outlet, said fabricated trough including a bottom plate, a pair of side plates and a top plate welded together, one of said side plates being on the side of the trough facing in the direction in which the mill rotates terminating a predetermined distance from the mill shell to define a scoop opening facing in the direction of rotation of the mill; and, a hollow conical funnel removably disposed within the hollow trunnion and arranged to be in communication with the discharge end wall outlet and to extend beyond the exterior end of the trunnion to receive the grinding media from said trough and to direct the grinding media through the hollow trunnion to the exterior thereof;

whereby the grinding media picked-up by said scoop will flow radially along said trough inwardly towards the mill center as the mill rotates and discharges into the funnel through the discharge end wall outlet to the exterior of the trunnion and said grinding media pick-up means being removed from within the shell after the grinding media has been removed from the mill to condition the mill for further operation with new grinding media.

2. A grinding media discharger according to claim 1 including a guide vane extending from said scoop opening of said trough along the interior of the shell body and operable to direct grinding media towards said scoop opening.

3. A grinding media discharger according to claim 1 wherein said hollow funnel is of frusto-conical configuration with the small diameter end being disposed to communicate with the discharge end wall outlet and the large diameter end of said funnel being located exteriorly of the trunnion, said frusto-conical funnel being removably secured within the hollow trunnion; and, means engageable with said funnel and the external end of the trunnion to removably secure said funnel in operative position within the hollow trunnion whereby the discharge of the grinding media through said funnel is in controlled flow path.

* * * * *